US009630056B2

(12) United States Patent
Rao

(10) Patent No.: US 9,630,056 B2
(45) Date of Patent: Apr. 25, 2017

(54) CRAWLING EXERCISER

(71) Applicant: Fitcrawl (Shanghai) Industry Co., Ltd., Shanghai (CN)

(72) Inventor: Minghu Rao, Shanghai (CN)

(73) Assignee: FITCRAWL (SHANGHAI) INDUSTRY CO., LTD., Shanghai (CN)

( * ) Notice: Subject to any disclaimer, the term of this patent is extended or adjusted under 35 U.S.C. 154(b) by 51 days.

(21) Appl. No.: 14/536,600

(22) Filed: Nov. 8, 2014

(65) Prior Publication Data

US 2015/0065311 A1 Mar. 5, 2015

Related U.S. Application Data

(63) Continuation of application No. 13/434,876, filed on Mar. 30, 2012, now abandoned, and a (Continued)

(30) Foreign Application Priority Data

Mar. 24, 2011 (CN) ..... 2011 1 0071902

(51) Int. Cl.

| | |
|---|---|
| ***A63B 26/00*** | (2006.01) |
| ***A63B 22/00*** | (2006.01) |
| ***A63B 69/18*** | (2006.01) |
| ***A63B 23/035*** | (2006.01) |
| ***A63B 71/00*** | (2006.01) |

(Continued)

(52) U.S. Cl.

CPC .... *A63B 23/03591* (2013.01); *A63B 21/4011* (2015.10); *A63B 21/4017* (2015.10); *A63B 22/20* (2013.01); *A63B 22/203* (2013.01); *A63B 23/0222* (2013.01); *A63B 23/03533* (2013.01); *A63B 23/03575* (2013.01); *A63B 71/0054* (2013.01); *A63B 2071/0072* (2013.01); *A63B 2208/0219* (2013.01); *A63B 2210/50* (2013.01)

(58) Field of Classification Search

CPC ..... A63B 22/00; A63B 22/20; A63B 22/201; A63B 22/203; A63B 23/00; A63B 23/035; A63B 23/03575; A63B 23/03591

USPC ..... 482/70–72, 79, 92, 139, 142

See application file for complete search history.

(56) References Cited

U.S. PATENT DOCUMENTS 3,363,335 A * 1/1968 Burhns ..... A61H 1/02 434/255

3,582,069 A * 6/1971 Flick ..... A63B 21/154 434/255

(Continued)

*Primary Examiner* — Stephen Crow

*Assistant Examiner* — Garrett Atkinson

(74) *Attorney, Agent, or Firm* — Kening Li; Miller Canfield

(57) ABSTRACT

The current invention relates to an exerciser, especially a crawling exerciser, comprising two hand slides each containing a wheel and two leg slides each containing a wheel, characterized in that, characterized in that it also contains components of a linear parallel track, wherein both the hand slides and the leg slides slide in the track and a damping structure is installed on the wheels or between the wheels and the track. The exerciser of the current invention is convenient, flexible, easy to control, and is easy to perform alternate movements of the hands and legs. It does not damage the floor, carpet or ground, and is very appropriate for indoor application.

10 Claims, 14 Drawing Sheets

Related U.S. Application Data continuation-in-part of application No. PCT/CN2011/001678, filed on Oct. 8, 2011.

(51) Int. Cl.

| | |
|---|---|
| ***A63B 22/20*** | (2006.01) |
| ***A63B 23/02*** | (2006.01) |
| ***A63B 21/00*** | (2006.01) |

(56) References Cited

U.S. PATENT DOCUMENTS

| | | | | | |
|---|---|---|---|---|---|
| 3,589,720 | A * | 6/1971 | Agamian | A63B 21/012 | 310/69 |
| 3,658,327 | A * | 4/1972 | Thiede | A63B 21/068 | 182/116 |
| 4,364,559 | A * | 12/1982 | Valentine | A63B 21/055 | 482/130 |
| 4,679,786 | A * | 7/1987 | Rodgers | A63B 21/154 | 482/54 |
| 4,799,475 | A * | 1/1989 | Iams | A63B 21/4049 | 434/255 |
| 4,865,317 | A * | 9/1989 | Hickey | A63B 21/05 | 482/126 |
| 5,224,909 | A * | 7/1993 | Hamilton | A63B 21/154 | 482/51 |
| 5,279,530 | A * | 1/1994 | Hess | A63B 21/0552 | 482/121 |
| 5,279,531 | A * | 1/1994 | Jen-Huey | A63B 23/0417 | 482/51 |
| 5,499,958 | A * | 3/1996 | Hess | A63B 21/0552 | 482/123 |
| 5,503,609 | A * | 4/1996 | Bull | A63B 21/154 | 482/51 |
| 5,700,232 | A * | 12/1997 | Clausen | A63B 21/0552 | 482/125 |
| 6,368,254 | B1 * | 4/2002 | Wall | A63B 21/055 | 482/122 |
| 7,462,139 | B2 * | 12/2008 | Stafiej | A63B 22/02 | 482/51 |
| 7,780,585 | B1 * | 8/2010 | Rivas | A63B 21/0552 | 482/140 |
| 7,892,152 | B1 * | 2/2011 | Teng | A63B 23/03541 | 482/142 |
| 7,951,050 | B2 * | 5/2011 | Raumann | A63B 22/0015 | 482/51 |
| 7,955,225 | B1 * | 6/2011 | James | A63B 22/0664 | 482/51 |
| 7,981,005 | B1 * | 7/2011 | Tsai | A63B 21/055 | 482/147 |
| 7,998,043 | B2 * | 8/2011 | Zhou | A63B 21/154 | 482/139 |
| 8,500,611 | B2 * | 8/2013 | Hoffman | A63B 21/055 | 482/123 |
| 9,180,332 | B1 * | 11/2015 | Tenorio | A63B 21/0557 | |
| 2001/0036885 | A1 * | 11/2001 | Castellot, Jr. | A63B 21/012 | 482/79 |
| 2003/0119635 | A1 * | 6/2003 | Arbuckle | A63B 22/0087 | 482/142 |
| 2008/0015095 | A1 * | 1/2008 | Savsek | A63B 21/0455 | 482/121 |
| 2008/0248935 | A1 * | 10/2008 | Solow | A63B 21/4037 | 482/142 |
| 2009/0105050 | A1 * | 4/2009 | Mayo | A63B 21/00192 | 482/70 |
| 2010/0248919 | A1 * | 9/2010 | Zhou | A63B 21/154 | 482/139 |
| 2011/0039667 | A1 * | 2/2011 | Teng | A63B 23/03541 | 482/142 |
| 2012/0108405 | A1 * | 5/2012 | Milo | A63B 22/203 | 482/142 |

* cited by examiner

CRAWLING EXERCISER

CROSS REFERENCE TO RELATED APPLICATIONS

This is a continuation of U.S. application Ser. No. 13/434,876 filed on Mar. 30, 2012, which is a CIP of International Application No. PCT/CN2011/001678, with an international filing date of Oct. 8, 2011 claiming priority to Chinese Application No. 201110071902.0, the entire disclosure of which is incorporated herein by reference.

FIELD OF THE INVENTION

The present invention relates to an exerciser, especially to a crawling exerciser.

BACKGROUND OF THE INVENTION

Crawling exercises have become a more and more popular modern exercise. Crawling exercises belong to horizontal movement (which mainly means that the human spine is horizontal to the ground during the movement). In comparison with the vertical position movements, the human spine is being protected due to low pressure, because the gravity can be reduced or completely eliminated during the horizontal movement. In addition, since the human brain and human heart are at the same horizontal level during the movement, the blood supply from the heart toward the brain can be dramatically increased. Therefore, it can be concluded that constant crawling exercise is very beneficial to human spine and cardiovascular system.

Since crawling exercises are very easily limited by the conditions of the location and the weather, it is hence necessary to develop an exerciser which can simulate crawling movements and overcome the limits of the location and the weather. At present, a crawling exerciser has been disclosed in the Chinese utility model application ZL03244692.6. As is shown in FIGS. 1 and 2, the disclosed exerciser has two hand controlling parts 1 and two leg controlling parts 2, wherein the hand controlling part is furnished with a grip 13 at the front and a slide wheel with a long axis 14 at the bottom of the back. The bottom part of the leg controlling part 2 is furnished with two slide wheels with long axis. As is shown in FIG. 3, the user kneels on the leg controlling part 2, puts his arm on the hand controlling part 1 and gripes the grip 13 as a pre-exercise condition. As shown in FIG. 4, during exercise, the hand controlling part 1 is lifted with the arm force, so that only the slide wheel 14 of the hand controlling part 1 touches the ground in order for the hand to control the back and forth movements. When the wrist is laid down, the front part of the hand controlling part 1 touches the ground to stop the movement. The leg controlling part 2 makes the toes above the ground in order for the legs to control the back and forth movements. When the toes touch the ground, the movement is stopped. The stopping and the starting of the movements alternate and coordinate with the movements of the hands and the legs, so that the human body can make crawling movements like a chameleon. As shown in FIG. 5, the exerciser can combine the two hand controlling parts 1 and the two leg controlling parts 2 respectively through self-adhesive zips 17, 24 in order to make the movements, so that the body can move back and forward like a bow.

Although the crawling exerciser in the state of the art can theoretically have the workout effect by crawling movement, it has the following flaws practically: First, it is hard to stop the movements. Since such an exerciser does not have a damping structure, and the body can move toward an arbitrary direction on the ground, therefore, one can only use hands and legs to stop the movements, that is, let the wrist laid down so that the front part of the hand controlling part touches the ground to stop the leg controlling part, and let the toes touch the ground to stop the leg controlling part Secondly, the exerciser can only facilitate smooth movements when the body takes up a bow-like form as shown in FIG. 5. But when the alternate crawling movements as demonstrated in FIG. 4 is desired, the four limbs are hard to be controlled and it is easy to fall down. This is due to the fact that when the two hand controlling parts 1 and the two leg controlling parts 2 are supporting the four limbs, as soon as the limbs have different forces or lean toward a certain direction, it can easily lead to the situation where the controlling bodies can hardly be controlled. Thirdly, since the wheels of the hand controlling parts and the leg controlling parts have direct contact with the ground, the friction can induce damages toward the floor, carpet or grounds, and therefore, it is not appropriate to use the exerciser indoors. Lastly, since the wheels of the hand controlling parts and the leg controlling parts do not have tracks for direction, their direction cannot be easily controlled.

SUMMARY OF THE INVENTION

The aim of the current invention is to provide a crawling exerciser which overcomes the shortcomings of the exercisers in the state of the art. The exerciser of the current invention is convenient, easy to control and is easy to perform alternate exercise between hands and legs. It does not damage the floor, carpet or ground and is appropriate to be used indoors.

In order to achieve the above objectives, the current invention is realized as the follows:

A crawling exerciser, comprising two hand slides each containing a wheel and two leg slides each containing a wheel, characterized in that, it also contains components of a linear parallel track, wherein both the hand slides and the leg slides slide in the track and a damping structure is installed on the wheels or between the wheels and the track.

The crawling exerciser as stated above, characterized in that the components of the track are soft rollable carpet track, and when the carpet is unfolded, the track is parallel and the cross section of the track is groove-shaped corresponding to the shape of the wheel.

The crawling exerciser as stated above, characterized in that the components of the track are soft rollable carpet track, and when the carpet is unfolded, the track is a straight, long fin height structure and is also designed to be parallel, wherein the outer part of the wheel is furnished with a curved groove in order to adapt to the fin-height-shaped track.

The crawling exerciser as stated above, characterized in that the components of the track are hard track components, wherein the wheels of the hand slides and the leg slides can make linear movements along the track, and the hand slides and the leg slides on the same side are connected with at least one elastic string.

The crawling exerciser as stated above, characterized in that the track components are designed to be foldable.

The crawling exerciser as stated above, characterized in that the track components are hard components, wherein the wheels of the hand slides and the leg slides can make linear movements along the track, and the wheels of the hand slides and the leg slides are further furnished with a volute spiral spring.

The crawling exerciser as stated above, characterized in that the track components are hard components, wherein the wheels of the hand slides and the leg slides can make linear movements along the track, and the wheels of the hand slides and the leg slides on the same side are furnished with an elastic string.

The crawling exerciser as stated above, characterized in that the track components are hard components, wherein the wheels of the hand slides and the leg slides can make linear movements along the track, the outer side of the track is changed to be a trapezoidal shape, and the inner side of the wheels of the hand slides and the leg slides, which contacts the track, is furnished with elastic buffering material in order to increase friction between the track and the wheels.

The crawling exerciser as stated above, characterized in that the track components have foldable structures.

The crawling exerciser as stated above, characterized in that there is a groove in the middle of the track, wherein the hand slides and the leg slides have a C shaped component which is encased within the groove.

The crawling exerciser as stated above, characterized in that the track takes up a ⊂ form, wherein the wheels of the hand slides and the leg slides have an inverted U shaped structure which encases the ⊂ shaped track.

The crawling exerciser as stated above, characterized in that the track takes up a T form, wherein the wheels of the hand slides and the leg slides have a shape with encases the T-shape structured track.

The crawling exerciser as stated above, characterized in that track is a round track which is parallel to each other, wherein the wheels of the hand slides and the leg slides have a shape with encases the round shape structured track.

The crawling exerciser as stated above, characterized in that the hand slides and/or the leg slides are further furnished with a straight catch pin structure in order to stabilize the slides onto the track.

The crawling exerciser as stated above, characterized in that the hand slides and/or the leg slides are further furnished with a cam controlling catch pin structure in order to stabilize the slides onto the track.

The crawling exerciser comprising hand slides and leg sides, characterized in that it also contains components of a linear parallel track, wherein both the hand slides and the leg slides slide in the track and a damping structure is installed between the hand slides, the leg slides or between the slides and the track.

The crawling exerciser as stated above, characterized in that the hand slides and the leg slides have a slide block or a linear bearing.

The crawling exerciser as stated above, characterized in that the track takes up a T form, wherein the slide block has a shape which encases the T-shape structured track.

The crawling exerciser as stated above, characterized in that track is a round track which is parallel to each other, wherein the slide block has a shape which encases the round shape structured track.

In comparison with the exerciser in the state of the art, the exerciser of the current invention has the following advantages and beneficial effects:

a. A damping structure is provided on the slides, so that the user can effectively control the slides.

b. The slides are furnished with track components so that the slides will not move astray, the ground (floor or carpet) can be protected and the wheels will not be damaged.

c. The tracks can be folded or rolled, which leads to a reduced volume of the exerciser. The exerciser is easy to be stored.

DESCRIPTION OF THE INVENTION

Example 1

Figure 1:
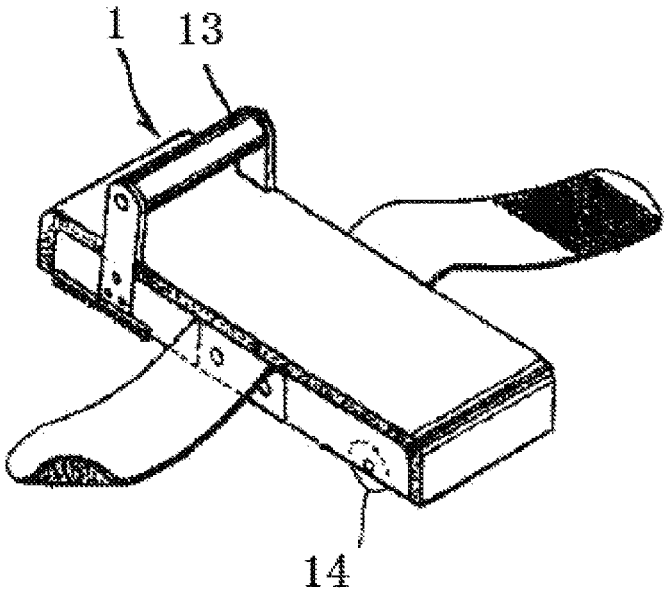
FIG. 1 shows structure of the hand controlling part of the crawling exerciser of the state of the art.
Figure 2:
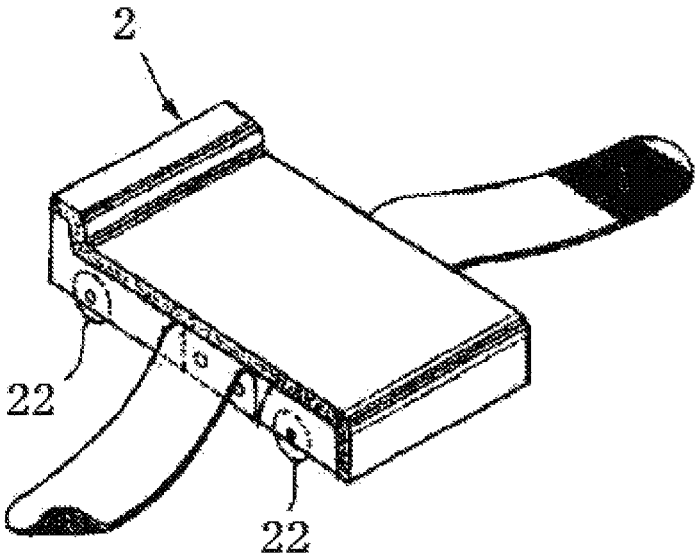
FIG. 2 shows the structure of the leg controlling part of the crawling exerciser of the state of the art.
Figure 3:
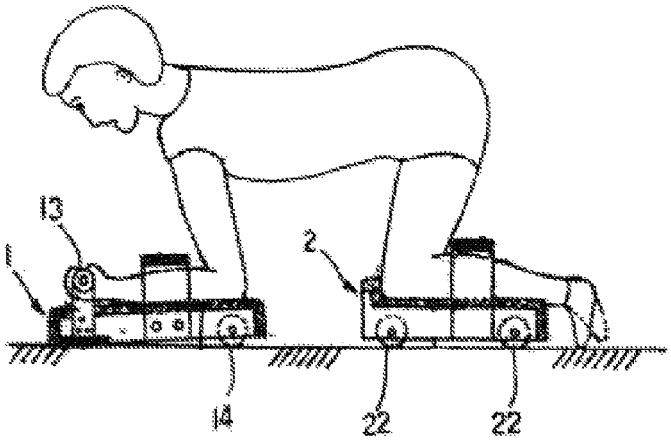
FIG. 3 shows the use of the crawling exerciser of the state of the art (preparation movement).
Figure 4:
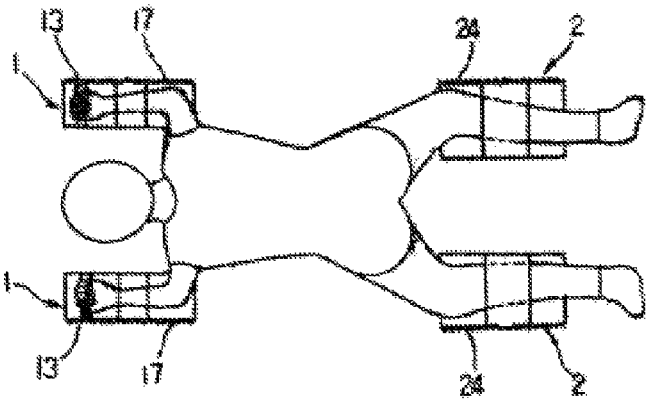
FIG. 4 shows the use of the crawling exerciser of the state of the art (alternate movements).
Figure 5:
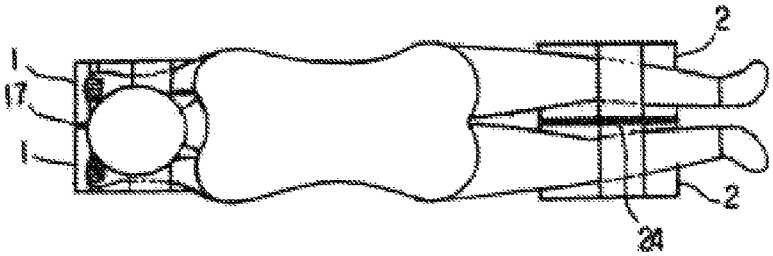
FIG. 5 shows the use of the crawling exerciser of the state of the art (crawling movements with a bow body shape).
Figure 6:
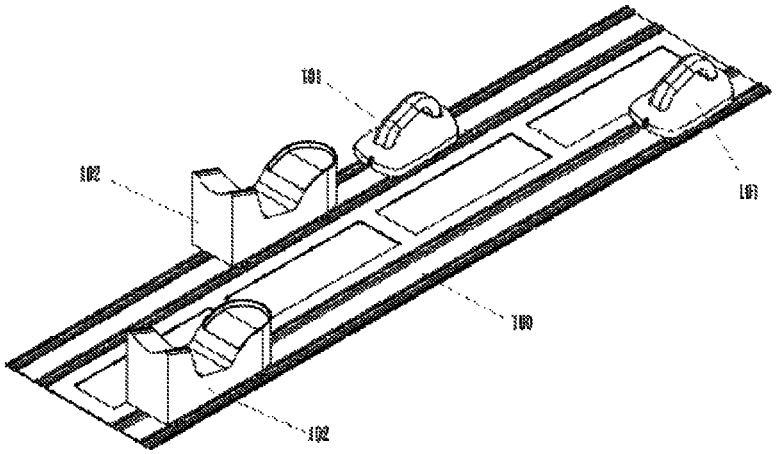
FIG. 6 shows the structure of a crawling exerciser of the current invention.
Figure 7:
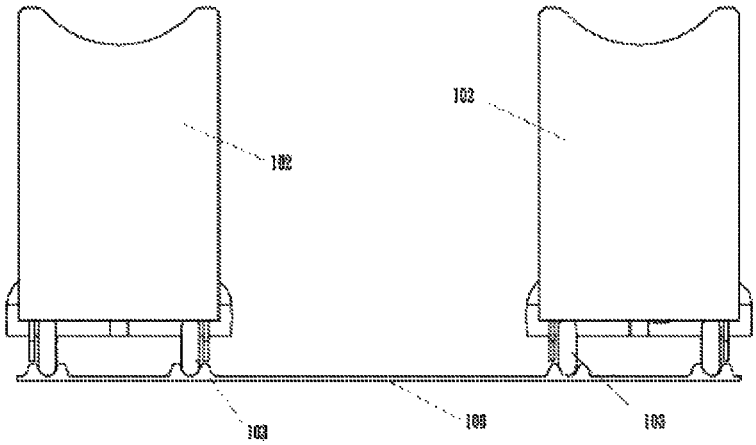
FIG. 7 shows the connection between the wheels and the track of example 1 of the current invention.

A crawling exerciser, as shown in FIGS. 6 and 7, comprises two hand slides 101 each containing a wheel and two leg slides 102 each containing a wheel 103. It contains a soft rollable carpet track 100, the material of which can be plastics, etc. When the carpet is unfolded, the track is parallel and the cross section of the track is groove-shaped, which corresponds with the shape of the wheel 103. Both the hand slides 101 and the leg slides 102 slide in the track and make linear movements so that the wheels will not move astray. In addition, the friction between the wheel and the groove of the track is used to provide damping in order to control the hand wheels 101 and the leg wheels 102. It is very easy to perform hand and leg alternate movements with this exerciser.

Example 2

Figure 8:
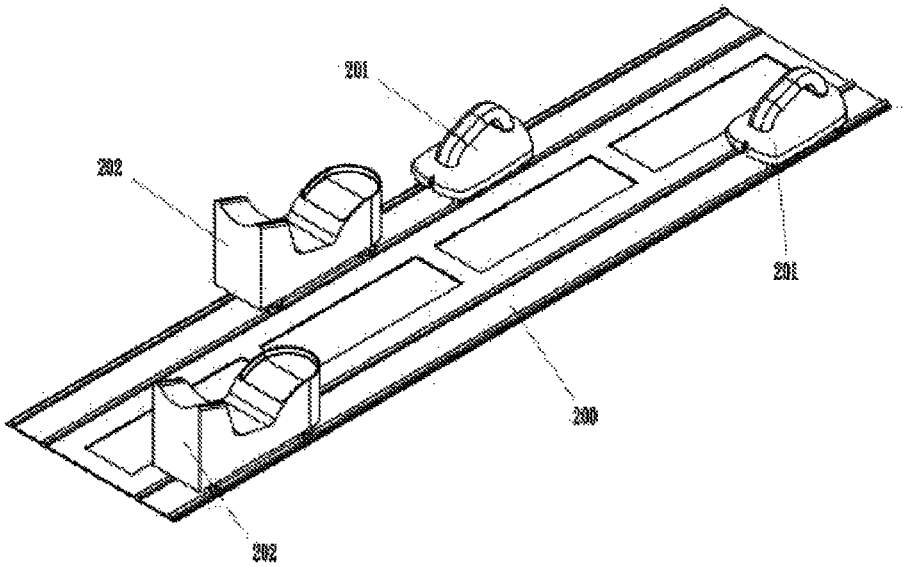
FIG. 8 shows the structure of example 2 of the current invention.
Figure 9:
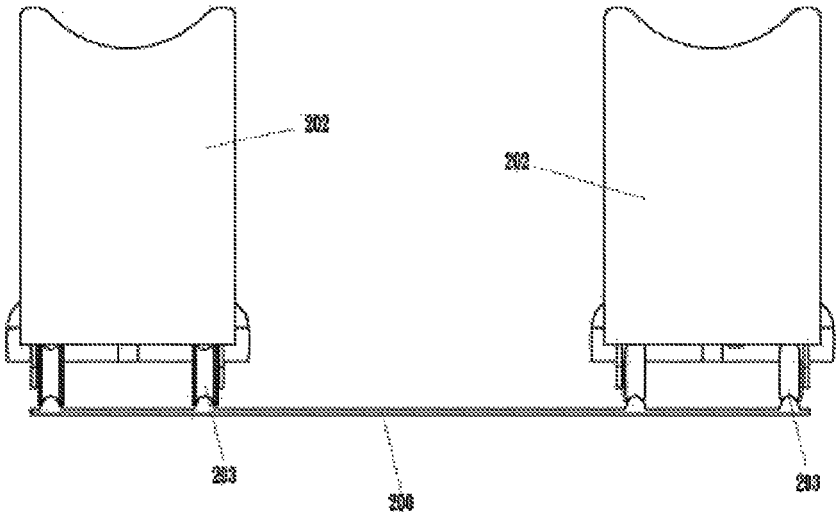
FIG. 9 shows the connection between the wheels and the track of example 2 of the current invention.

A crawling exerciser, as shown in FIGS. 8 and 9, comprises two hand slides 201 each containing a wheel and two leg slides 202 each containing a wheel 203. It contains a soft rollable carpet track 200, the material of which can be plastics, etc. When the carpet is unfolded, the track is parallel and is a straight, long fin height structure. The outer part of the wheel 203 is furnished with a curved groove in order to adapt to the fin-height-shaped track. When it is used, the outer part of the wheel of the hand slide 201 and the leg slide 202 is furnished with a groove in order to adapt to the fin-height-shaped track. The slides can make linear movements so that the wheels will not move astray. In addition, the friction between the wheel and the groove of the track is used to provide damping in order to control the hand wheels 201 and the leg wheels 202. It is very easy to perform hand and leg alternate movements with this exerciser.

Example 3

Figure 10:
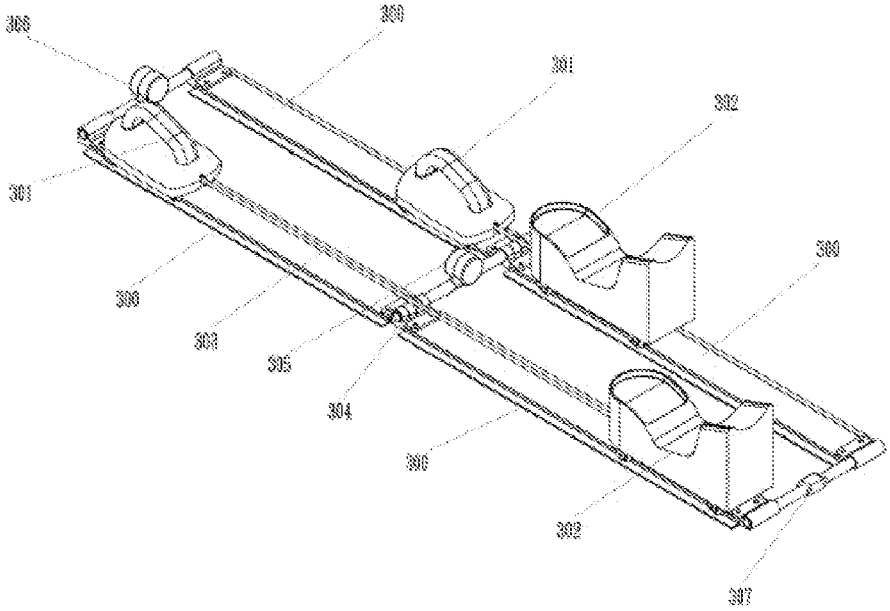
FIG. 10 shows the structure of the exerciser of example 3.

A crawling exerciser, as shown in FIG. 10, comprises two hand slides 301 each containing a wheel and two leg slides 302 each containing a wheel. It contains parallel track components 300. The hard track components 300 can be made of non-metallic material (such as plastics) or metals (aluminum or iron or etc); The shape of the track can be groove-shaped, fin height shaped, or trapezoidal, etc. It can also be two parallel round tubes. The hand slides 301 and the leg slides 302 can make linear movements so that the wheels will not move astray. In order to increase the damping of the hand slide 301 and leg slide 302 to increase their controllability, an elastic string 303 (or more than one string) is provided between the hand slide 301 and the leg slide 302 on the same side in this example. In this way, it is easier to perform alternate movements with the hands and the legs.

Figure 11:
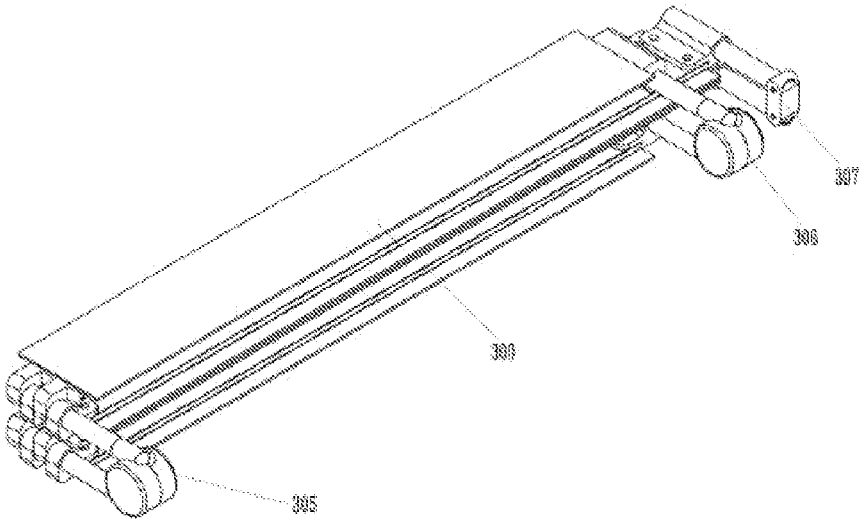
FIG. 11 shows the structure of the track components of example 3 of the current invention are they are folded.

In addition, in order to solve the storage space problem of the exerciser, the track components of the exerciser of the current example are all foldable. There are the hinge 304 and hinge heads 305, 306, 307 furnished in the middle and on both sides of the track components in order to realize the double way folding of the track components. Due to the presence of the folding structure, the track is composed of the left and right hand track and the left and the right leg track. The left hand track and the left leg track are connected with the hinge, whereas the right hand track and the right leg track are connected with hinge. The two left (hand and leg) track and the two right (hand and leg) track are connected with three rods which are positioned in the front, middle and back part of the tracks in order to keep the left and right tracks parallel. There are three hinge heads 305, 306 and 307 are furnished in the middle of the three rods, in which the hinge head 307 at the back part of the tracks can be made of two axes, in order to prevent inconvenient folding when the axes of the three hinge heads are not aligned together. The track components when they are folded are shown in FIG. 11. The volume of the track is reduced dramatically and can be easily stored.

On the basis of example 3, the following structure and methods are used to replace the elastic string 303 in order to increase the damping of the hand slides and the leg sides.

Figure 12:
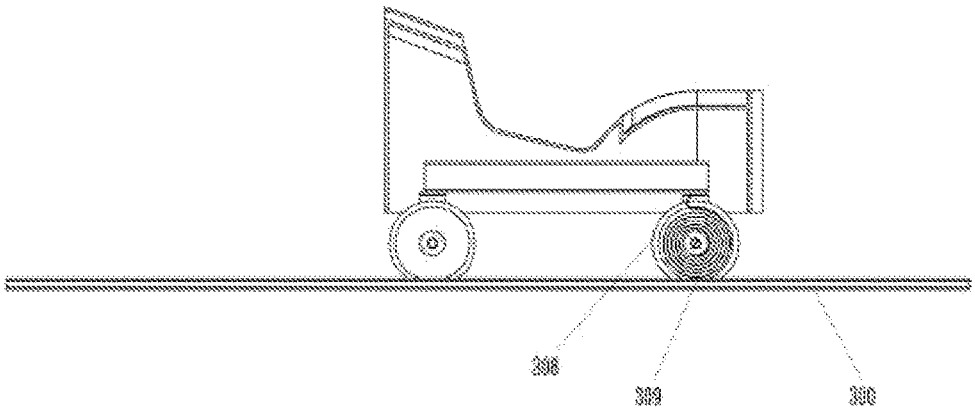
FIG. 12 is an alternative structure of the damping structure of example 3 of the current invention.

As shown in FIG. 12, the wheels 308 of the hand slide and the leg slide are further furnished with a volute spiral spring 309.

Figure 13:
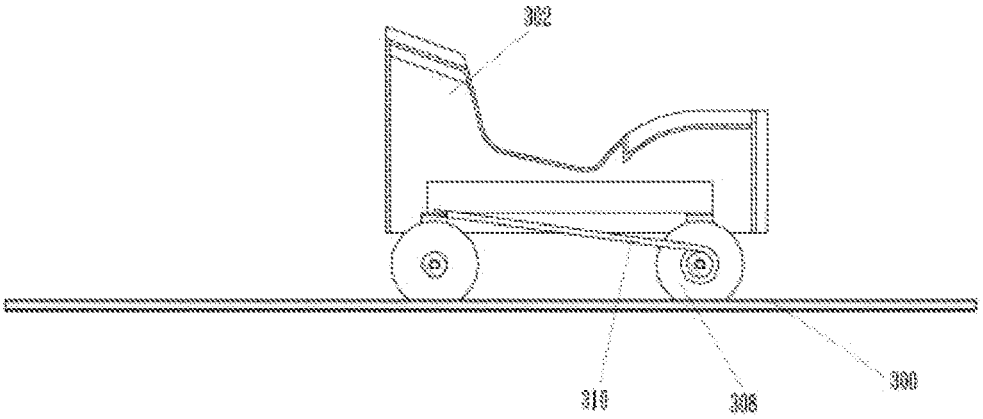
FIG. 13 is an alternative structure of the damping structure of example 3 of the current invention.

As shown in FIG. 13, an additional elastic string 310 is furnished on the wheel 308 of the hand slide and the leg slide.

Figure 14:
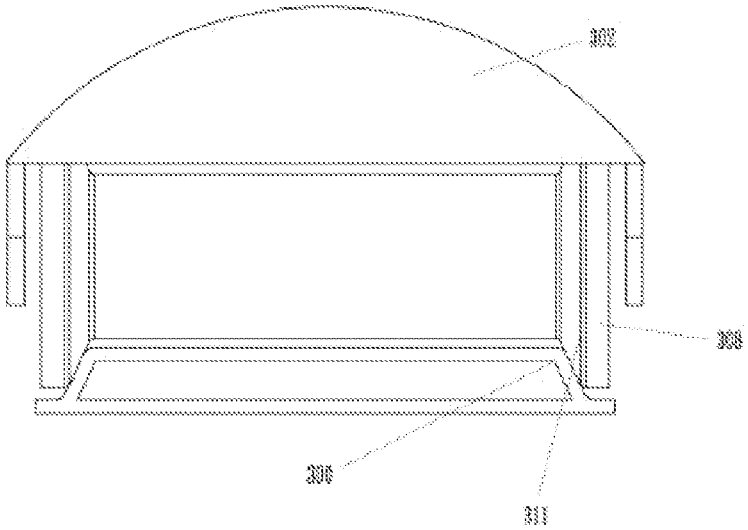
FIG. 14 is another alternative structure of the damping structure of example 3 of the current invention.

As shown in FIG. 14, the cross section shape of the track 300 is changed to be trapezoidal. The elastic buffering material 311 is furnished on the inner side (which contacts the track) of wheel 308 of the hand slide and the leg slide in order to increase the friction between the wheel 308 and the track 300.

Example 4

Figure 15:
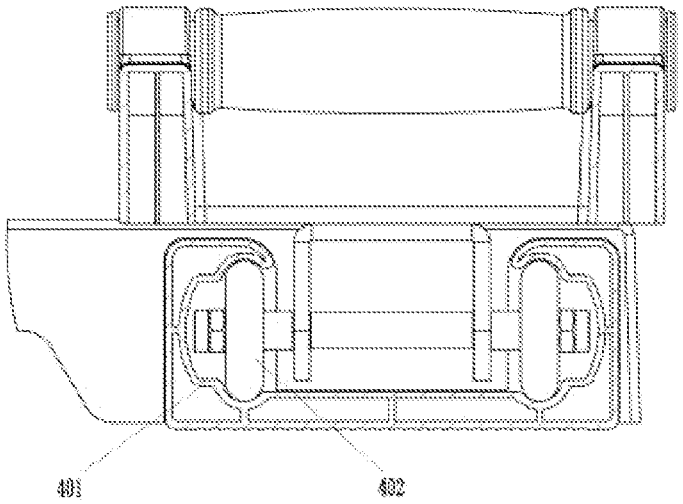
FIG. 15 is the cross section of the cooperation between the track and the wheels of the crawling exerciser in example 4 of the current invention.
Figure 16:
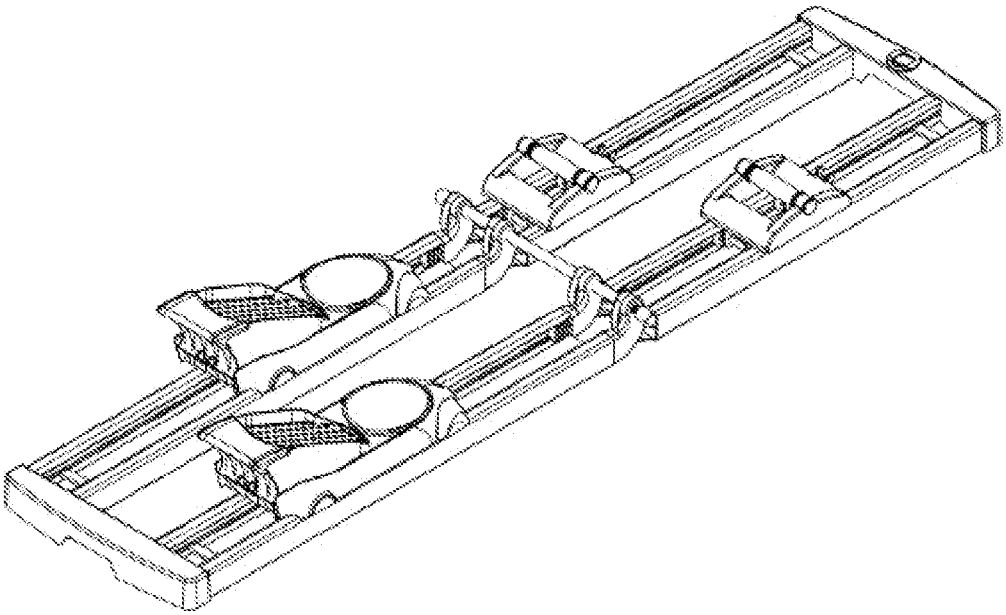
FIG. 16 is the structure of the crawling exerciser of example 4 of the current invention.

As shown in FIG. 15, the track 401 has a groove which encases the wheel 402 having a C-shaped shape. Even when the wheel 402 slides very fast, it will not roll out of the track 401, so that the safety of the user is secured. FIG. 16 shows the structure of the exerciser with this kind of track and wheel structure.

Example 5

Figure 17:
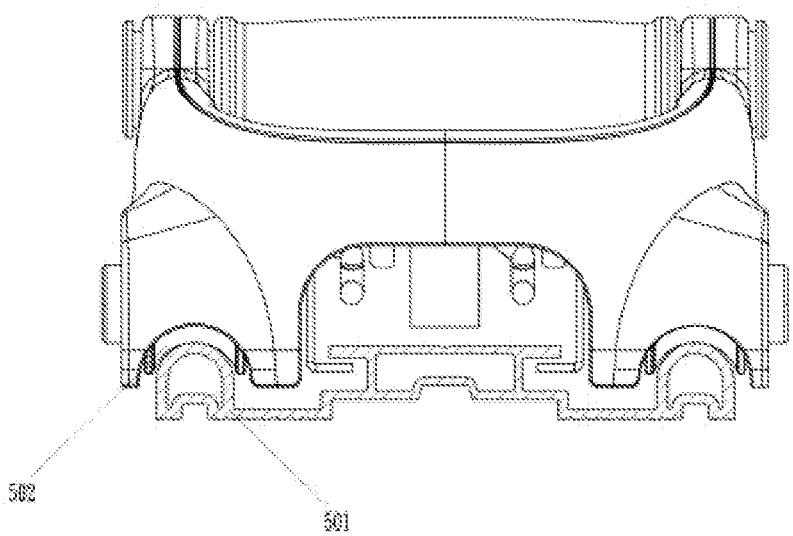
FIG. 17 is the cross section of the cooperation between the track and the wheels of the crawling exerciser in example 5 of the current invention.
Figure 18:
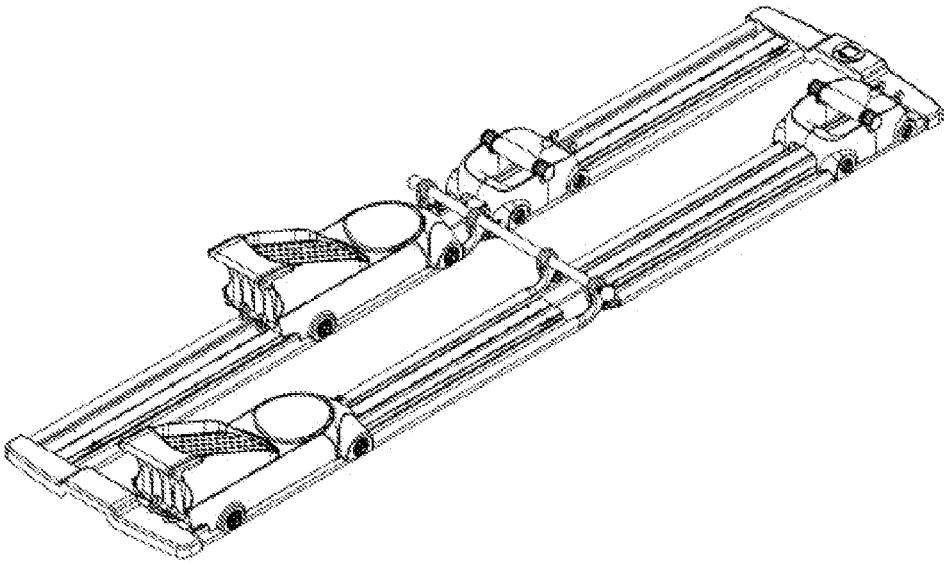
FIG. 18 is the structure of the crawling exerciser of example 5 of the current invention.

As shown in FIG. 17, the track 501 has ⊂ shape. The wheel 502 has an inverted U shape. The wheel 502 slides within the track 501 so that it will not fall out of the track 501 and the safety of the user is secured. FIG. 18 shows the structure of the exerciser of such kind of track and wheel.

Figure 29:
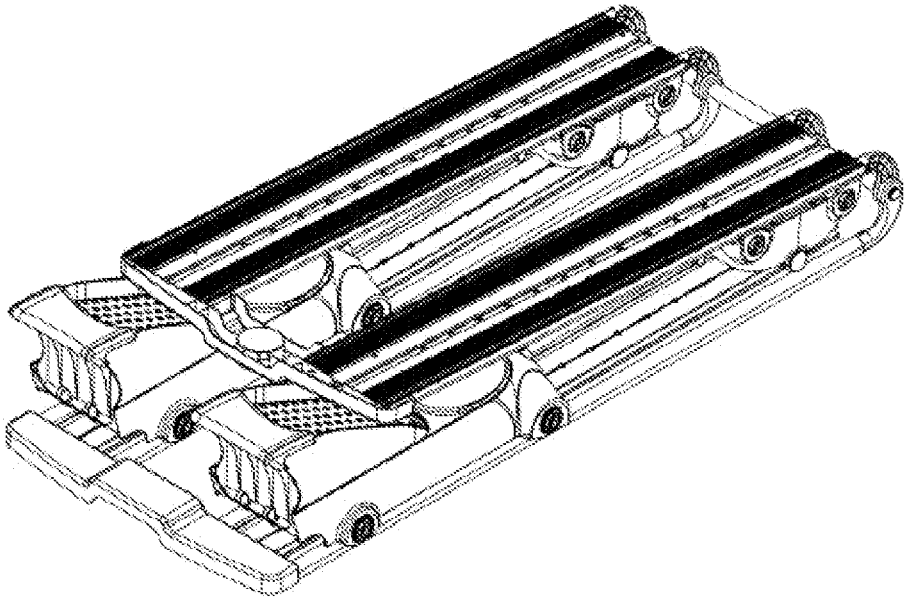
FIG. 29 shows the structure of the track components of example 5 of the current invention are they are folded.

In addition, in order to solve the storage space problem of the exerciser, the track components of the exerciser of the current example are all foldable. There are the hinges furnished in the middle of the track components in order to realize the folding of the track components. Due to the presence of the folding structure, the track is composed of the left and right hand track and the left and the right leg track. The left hand track and the left leg track are connected with the hinge, whereas the right hand track and the right leg track are connected with hinge. The track components when they are folded are shown in FIG. 29. The volume of the track is reduced dramatically and can be easily stored.

Example 6

Figure 19:
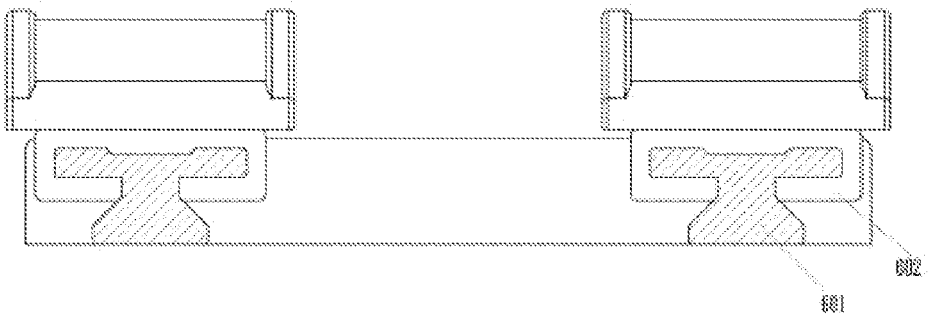
FIG. 19 is the cross section of the cooperation between the track and the slide block in example 6 of the current invention.
Figure 20:
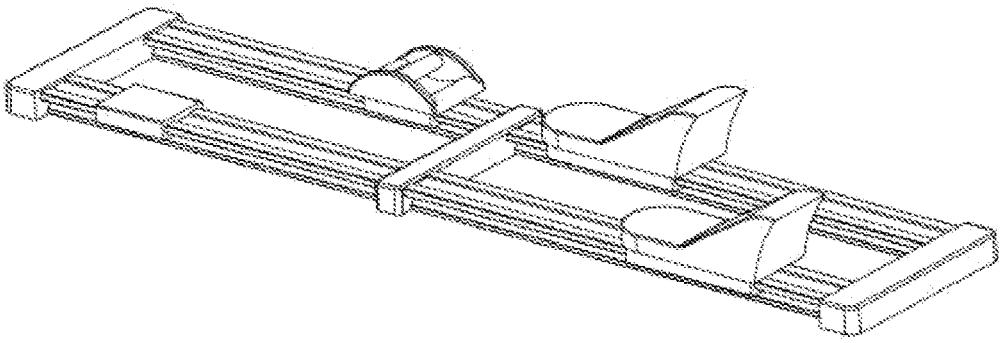
FIG. 20 is the crawling exerciser of example 6 of the current invention.

As shown in FIG. 19, the track 601 has a T shape. The slide block 602 contains the shape of the track 601. After the user exerts forces, the slide block 602 slides within the track 601. Even when the speed of the slide block 602 is very high, it will not fall off the track, so that the safety of the exerciser is secured. FIG. 20 shows the structure of the exerciser of such kind of track and wheel.

Example 7

Figure 21:
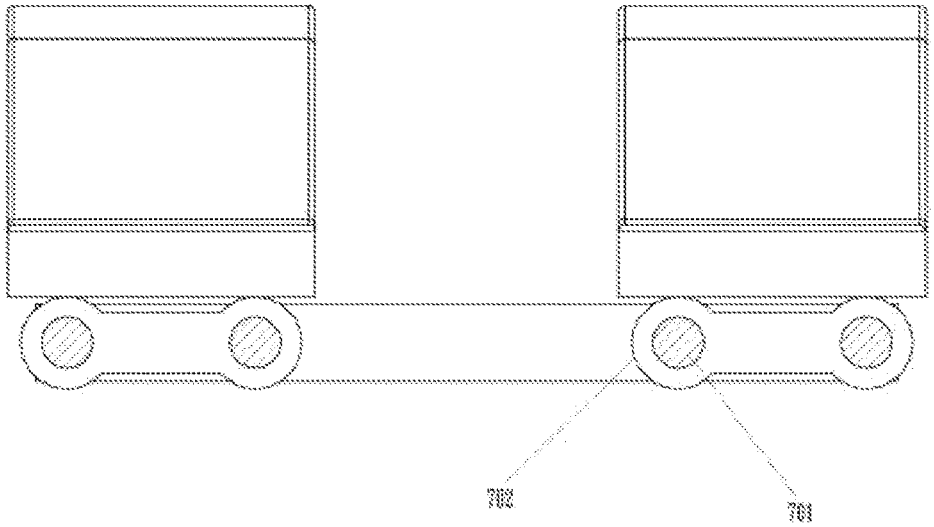
FIG. 21 is the cooperation between the track and the slide block of example 7 of the current invention.
Figure 22:
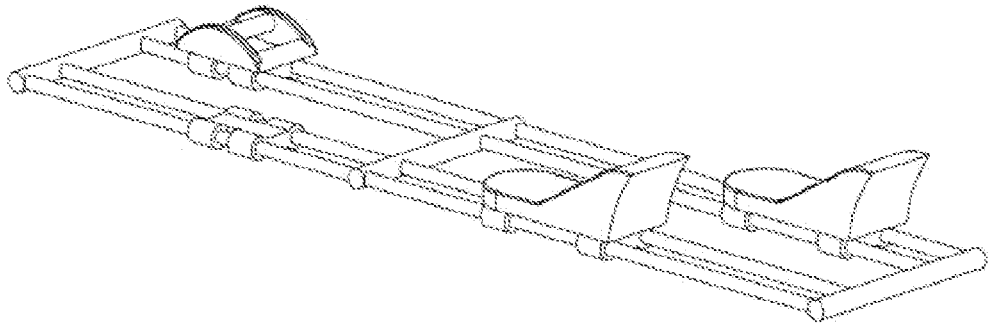
FIG. 22 is the structure of the crawling exerciser of example 7 of the current invention.

As shown in FIG. 21, the track 701 is parallel round shaped track. The slide block 702 has a round shape, which wraps the track 701 and is positioned outside the track 701. After the user exerts forces, the slide block 702 slides within the track 701. Even when the speed of the slide block 702 is very high, it will not fall off the track, so that the safety of the exerciser is secured. FIG. 22 shows the structure of the exerciser of such kind of track and wheel.

Example 8

Figure 23:
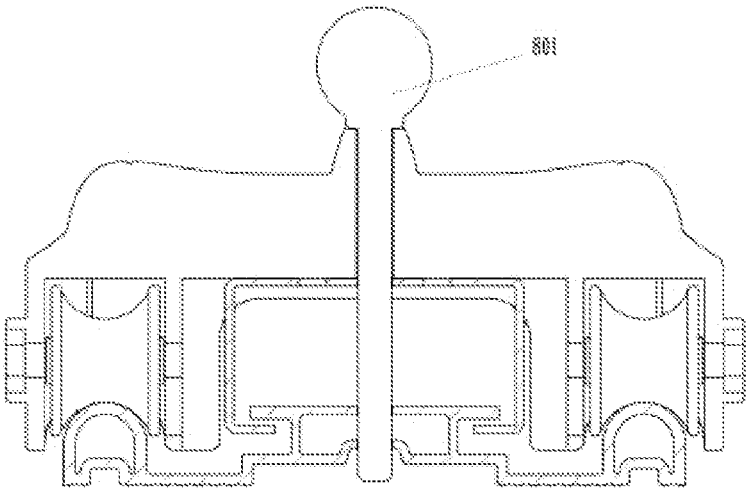
FIG. 23 show the cross section of the cooperation between the straight catch pin and the wheel with a pin hole in example 8 of the current invention.
Figure 24:
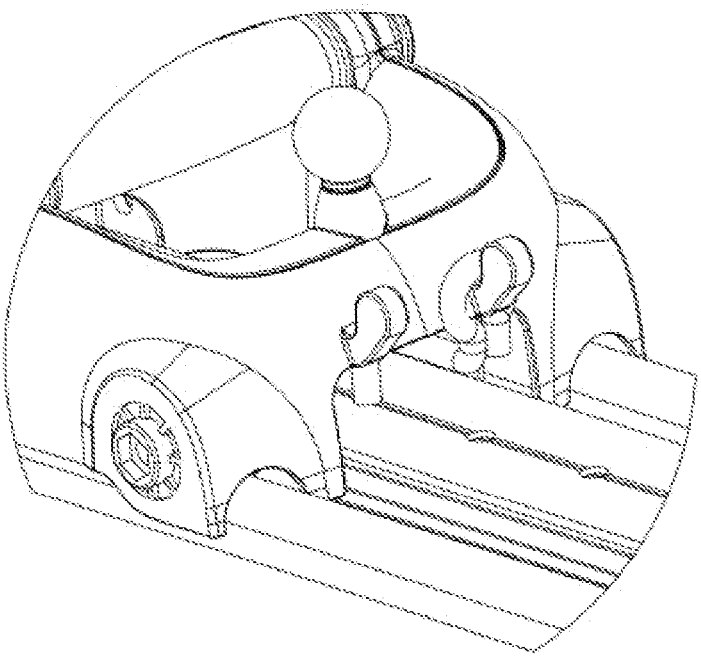
FIG. 24 is the 3D structure of the hand slide with the straight pin catch structure in example 8 of the current invention.
Figure 25:
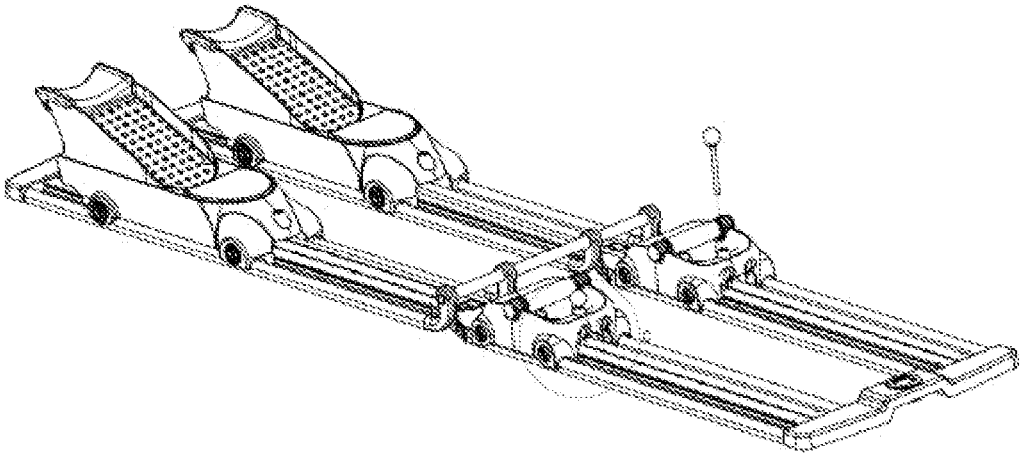
FIG. 25 is the structure of the crawling exerciser of example 8 of the current invention.

As shown in FIG. 23, there is a pin hole on the wheel. When the wheel needs to be fixed, a retaining structure such as the catch pin 801 is inserted into the pin hole. FIG. 24 shows the 3D structure of the hand slide which is fixed by the catch pin 801. FIG. 25 shows the structure of the exerciser with this catch pin structure.

Example 9

Figure 26:
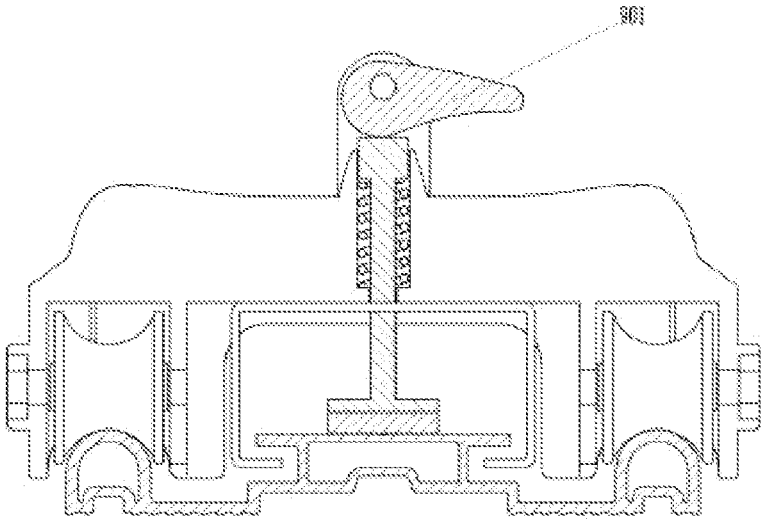
FIG. 26 shows the cross section of the cooperation between the pin catch with a fin height structure and the wheel with a hole in example 9 of the current invention.
Figure 27:
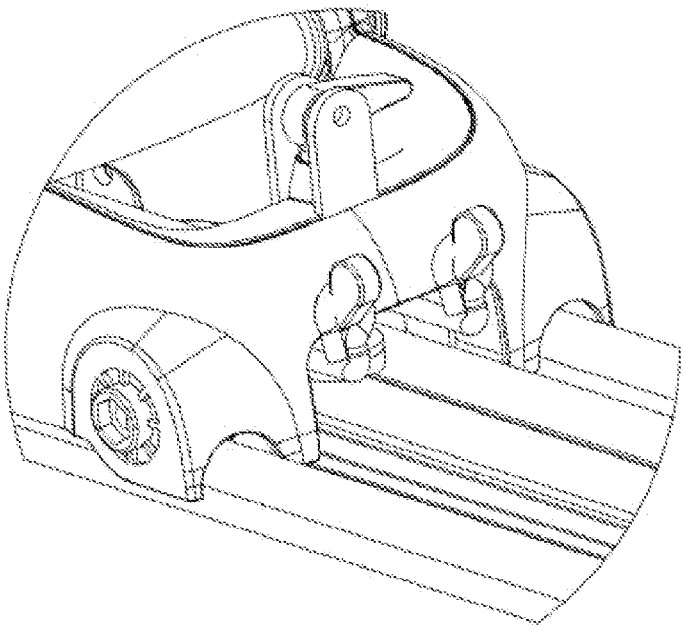
FIG. 27 shows the 3D structure of the hand slide with a catch pin with a fin height structure in example 9 of the current invention.
Figure 28:
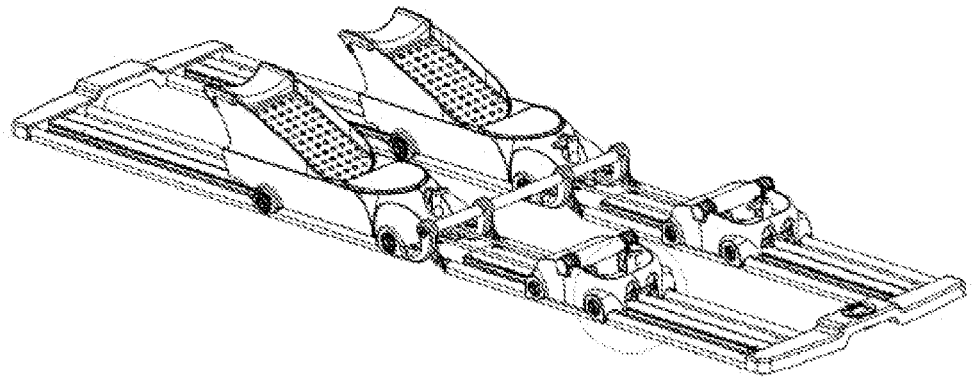
FIG. 28 shows the structure of the crawling exerciser with a catch pin with a fin height structure in example 9 of the current invention.

In comparison with example 8, the retaining structure such as the catch pin of the exerciser of this example has a fin height shaped catch pin. Take the hand slide for example, the fin height shaped catch pin 901 in FIG. 26 is rotatable. When it is inserted into the pin hole of the wheel of the hand slide, the fin height shaped catch pin 901 is rotated to a certain degree and the wheel is then locked. FIG. 27 shows the 3D structure of the fin height shaped catch pin 901 of the hand slide. FIG. 28 shows the structure of the exerciser with this type of catch pin structure.

The above are only relatively good examples of the current invention, and are by no means used to limit the scope of the current invention. Any modification and changes within the scope of the application all belong to the current scope of protection of the current invention.

What is claimed is:

1. A crawling exerciser, comprising left hand and right hand slides, left leg and right leg slides, and left and right parallel tracks, wherein a damping structure is installed on each slide, wherein the left track comprises a left hand track and a left leg track connected to the left hand track via a folding structure, and the right track comprises a right hand track and a right leg track connected to the right hand track via a folding structure, wherein the left hand slide moves in and along the left hand track, the left leg slide moves in and along the left leg track, the right hand slide moves in and along the right hand track, and the right leg slide moves in and along the right leg track, wherein the left hand slide, the right hand slide, the left leg slide and the right leg slide each comprises a retaining structure to fix the slide at different positions of the corresponding track.

2. The crawling exerciser according to claim 1, wherein the tracks are hard tracks, and each slide has a wheel to make advance and return movement along the track.

3. The crawling exerciser according to claim 2, wherein the tracks are linear.

4. The crawling exerciser according to claim 2, wherein the tracks are designed to be foldable.

5. The crawling exerciser according to claim 1, wherein each track comprises multiple adjustment holes.

6. The crawling exerciser according to claim 5, wherein each slide is fixed at different positions of the track through inserting the retaining structure into one of the adjustment holes.

7. The crawling exerciser according to claim 1, wherein the hand slide and the leg slides on the same side are connected with at least one elastic string.

8. The crawling exerciser according to claim 1, wherein the hand slides and the leg slides are furnished with a slide block or a linear bearing.

9. The crawling exerciser according to claim 1, wherein the folding structure is a hinge.

10. The crawling exerciser according to claim 1, wherein the retaining structure is a catch pin or a cam-controlling catch pin.

* * * * *